United States Patent [19]

Smith et al.

[11] Patent Number: 4,650,475

[45] Date of Patent: Mar. 17, 1987

[54] METHOD AND APPARATUS FOR THE INJECTION OF PHARMACEUTICALS

[76] Inventors: Carol Smith, 6 Walley St., Bristol, R.I. 02809; Denise Pezzullo, 40 Lawnacre Dr., Cranston, R.I. 02920

[21] Appl. No.: 756,108

[22] Filed: Jul. 18, 1985

[51] Int. Cl.[4] ..... G09F 30/00

[52] U.S. Cl. ..... 604/189; 604/905; 604/411; 604/415; 128/771

[58] Field of Search ..... 128/771; 604/411–415, 604/189, 110, 283, 905; 138/104

[56] References Cited

U.S. PATENT DOCUMENTS

| | | | |
|---|---|---|---|
| 2,020,828 | 11/1935 | Goldberg | 604/243 |
| 2,727,516 | 12/1955 | Lockhart | 604/212 |
| 3,181,529 | 5/1965 | Wilburn | 604/213 |
| 3,487,574 | 1/1970 | Loof | 138/104 |
| 3,534,777 | 10/1970 | Loof | 138/104 |
| 3,698,383 | 10/1972 | Baucom | 604/189 |
| 3,787,993 | 1/1974 | Lyon | 40/310 |
| 3,885,562 | 5/1975 | Lampkin | 604/189 |
| 4,058,121 | 11/1977 | Choksi et al. | 604/411 |
| 4,150,673 | 4/1979 | Watt | 604/110 |
| 4,191,185 | 3/1980 | Lemieux | 604/283 |
| 4,202,351 | 5/1980 | Biche | 40/316 |
| 4,505,709 | 3/1985 | Froning et al. | 604/411 |
| 4,547,194 | 10/1985 | Moorehead | 604/283 |
| 4,576,185 | 3/1986 | Proud et al. | 604/189 |

*Primary Examiner*—C. Fred Rosenbaum
*Assistant Examiner*—Mark Rooney
*Attorney, Agent, or Firm*—Lane & Aitken

[57] ABSTRACT

A penetrator for fully draining the liquid in multi-dose vials when drawing liquid into a syringe is disclosed. The apparatus also provides a cuff and a sleeve that are encoded for preventing misidentification of the contents of a syringe by identifying the syringe with the vial from which the contents of the syringe were drawn. The cuff is mounted on the penetrator and the sleeve is mounted on the port end of the syringe, so that a mismatch between the cuff and sleeve is readily detected when the port end of the syringe is attached to the penetrator to withdraw liquid from the vial.

8 Claims, 3 Drawing Figures

METHOD AND APPARATUS FOR THE INJECTION OF PHARMACEUTICALS

BACKGROUND OF THE INVENTION

1. Field of the Invention

The present invention relates to the safety of medical treatment involving the injection of liquid pharmaceuticals. More particularly, the present invention is related apparatus and procedures for assuring correct use of liquid pharmaceuticals that are administered in injection.

2. Discussion of the Related Art

The problem of assuring that liquid pharmaceuticals are not injected inadvertently through confusion with other liquids that are similar in appearance has become a subject of particular concern recently. Many pharmaceuticals that are administered by I.V. injection are clear, colorless liquids, and almost all of them are water-based. Thus they often are visually indistinguishable from each other. The confusion has produced irreversible harm in some cases: for example, fatal heart failure when a strong muscle relaxant was administered to a patient instead of an anesthetic. The danger of such deadly errors occurring is most acute under operating room and emergency room conditions, where time pressure and the need for effective deligation and coordination among hospital personnel become most acute.

The standard procedure for preventing such misidentification errors in administering injections has been to place a piece of surgical tape on a syringe before a pharmaceutical is drawn into it and to write the name of the drug thereon. Differences in handwriting, the phoenetic and orthographic similarity between the names of pharmaceuticals, and also the smearing and distortion that occur when the water-resistant, textured surface of surgical tape is used to label a syringe, are all sources of error in this procedure. This use of surgical tape is a convenient method but it has proven to be dangerously unreliable.

Furthermore, in present practice a needle is commonly used to withdraw liquids from multi-dose vials. This frequently wastes part of the liquid, which is discarded as being to difficult to extract. Also, since the penetrators are plastic, they are less expensive than needles.

SUMMARY OF THE INVENTION

Injection apparatus in accordance with the present invention comprises an encoded cuff and a sleeve that is encoded to match. The cuff and sleeve are adapted to be securely mounted on a penetrator and on the port end of a syringe barrel, respectively. The cuff is adapted to be mounted on the distal end of the penetrator so that when the pharmaceutical liquid in the container is supplied to the port end of the syringe through the penetrator, the cuff is proximate to the sleeve. Thus the cuff mounted on the penetrator that is inserted into a container, and the sleeve that has been mounted on a syringe chosen to inject the liquid are readily compared when the syringe is filled and the encoded sleeve identifies the container from which the liquid in the syringe was drawn.

Apparatus in accordance with the present invention provides a clear, durable, and highly reliable means of identifying the pharmaceutical contained in a syringe, to assure correct use of liquid pharmaceuticals.

BRIEF DESCRIPTION OF THE DRAWING

The nature and advantages of the present invention will be better understood when the detailed description of a preferred embodiment provided below is considered in conjunction with the drawing provided, in which.

In this drawing like parts have the same reference numerals.

DETAILED DESCRIPTION OF A PREFERRED EMBODIMENT

Figure 1:
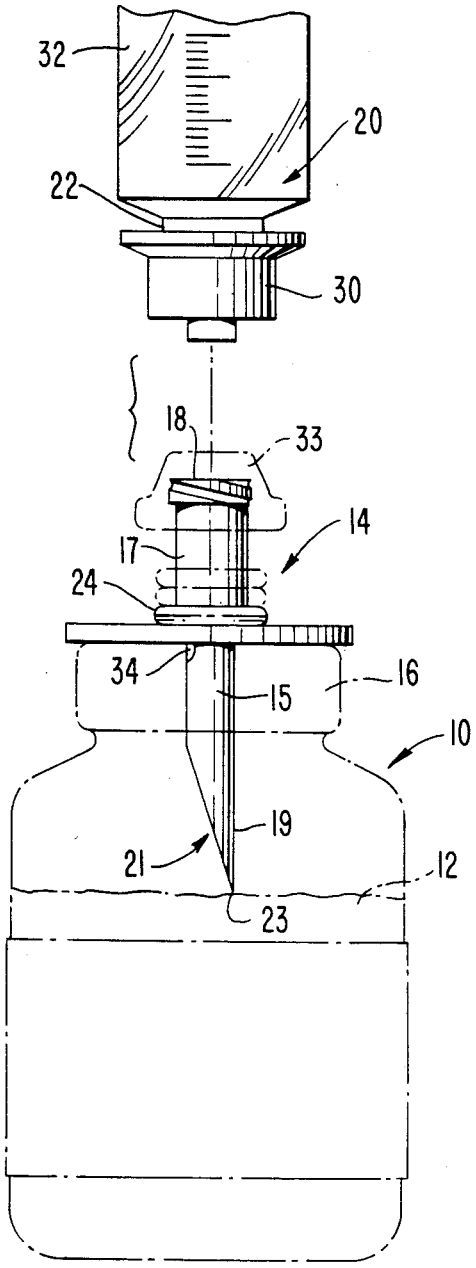
FIG. 1 is a schematic diagram of apparatus in accordance with the present invention.

With reference to FIG. 1, a multi-dose vial 10 (shown in phantom) containing a sterile liquid solution 12 of a pharmaceutical suitable for injection is prepared for use by inserting a sterile penetrator 14 through the top of the lid 16 which seals the outlet of the vial 10.

the distal end of the shaft 17 of the penetrator 14 is molded as a ridged ring 18 which permits a syringe to be temporarily locked onto the penetrator 14 while the liquid solution 12 is drawn into the syringe 20 through the oblique opening 21 on the shaft 15 of the penetrator 14. The port end of the syringe 20 carries a complementary ridged ring 22 into which the penetrator 14 is inserted and then twisted, which locks the syringe and penetrator together. The proximal portion of the shaft 19 ends in a pointed tip 23 which pierces the lid 16 of the vial 10.

After the penetrator 14 is inserted in the vial 10 a slightly elastic encoded cuff 24 can be readily slipped over the ridged ring 18 onto the penetrator 14. In the presently preferred embodiment, several smooth, brightly colored, O-rings made of an elastomer such as neoprene, all having the same color, are snugly fitted on the distal shaft of the penetrator to form a distinctive, inexpensive, and highly visible cuff 24. Each cuff 24 is associated with one or more encoded sleeves 30 which carry matching coding, which in this embodiment is provided by FDA-approved coloring agents. Bar code stripes or a raised pattern may also be used with or without color coding to encode the cuff 24.

Figure 2:
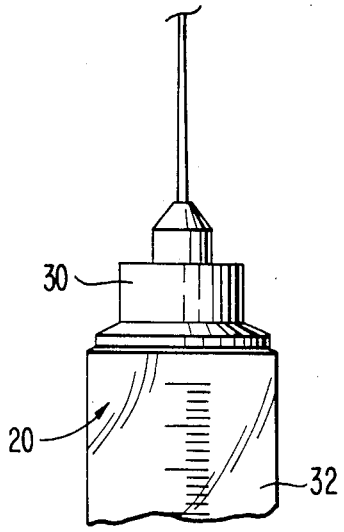
FIG. 2 is a schematic diagram of syringe apparatus in accordance with the present invention.

Before a syringe 20 is locked onto the penetrator 14, an encoded sleeve 30 is slipped onto the port end of the syringe 20. Thereafter, friction between the complementary ridged ring 22 and the sleeve 30 holds the sleeve 30 against the barrel 32 of the syringe 20 while the syringe is in use, as is shown in FIG. 2. The encoding on this sleeve 30 matches the encoding on the cuff 24.

Figure 3:
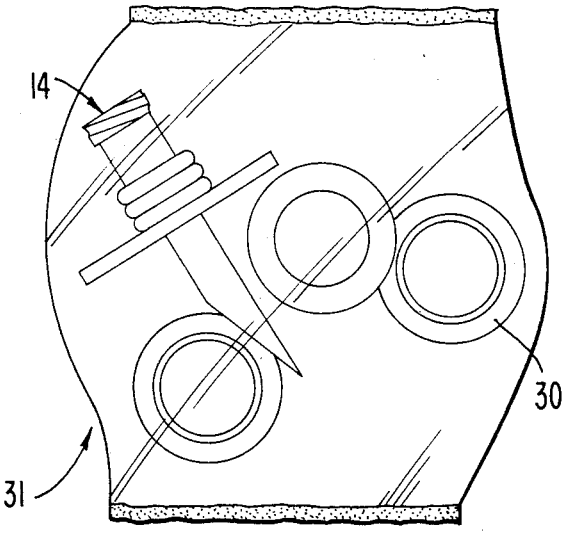

In the presently preferred embodiment, a penetrator with the color-coded cuff already fitted thereon and two matching color-coded sleeves are provided as a set, each set having one of a series of highly distinctive colors. The sets are presterilized and enclosed in individual sterile packets that can be readily torn open for use, as shown in FIG. 3, and are disposable. Thus, apparatus according to the present invention is suitable for use in a sterile environment, when opened in a sterile field.

The sleeve 30, in the presently preferred embodiment, provides a highly visible colored area covering the lateral surface of the syringe from its tip to the side wall of the barrel 32 on port end of the syringe 20. Thus, the match between the coding on the penetrator in the vial and on the syringe identifies the liquid in the syringe.

When the syringe 20 is being filled, the complementary ridged ring 22 which is covered by the sleeve 30 is first locked onto the penetrator 14. The syringe 20 and vial 10 are then inverted and the plunger of the syringe (not shown) is slowly pulled downward. While liquid is being drawn into the syringe 20, the person preparing the syringe carefully watches the liquid entering the syringe 20 to prevent air from being drawn into it, as well as to detect when sufficient liquid has been drawn into the syringe. Thus the sleeve 30 and cuff 24 are at the focus of attention at this time, and a mismatch between them will be obvious to anyone using this apparatus.

The encoded penetrators 14 remain with their respective vials 10. Penetrators on vials that are not empty are sealed with a cap 33 (shown in phantom) for storage and remain with the vials until they are empty. Thus a given syringe can be rematched with the relevant vial 10 at any time before the vial itself is destroyed. Furthermore, a side opening 34 in the shaft 17 of the penetrator 14 is provided in the preferred embodiment that is located just inside the vial 10 adjacent to the lid 16 when the penetrator 14 is inserted in the vial 10. Thus the vial 10 can be completely drained by the penetrator 14. This prevents wasting the last few drops of the liquid which are very difficult to withdraw when a needle is used to pierce the lid instead of the penetrator.

The invention may be embodied in other specific forms without departing from its spirit or essential characteristics. For example, permanent encoding can be provided on the penetrator or on the container label, which includes coding that matches coding on a sleeve, like the sleeve disclosed above. The presently preferred embodiment is, therefore, to be considered in all respects as illustrative and not restrictive, the scope of the invention being indicated by the claims rather than by the foregoing description, and all changes which come within the meaning and range of the equivalents of the claims are therefore intended to be embraced therein.

We claim:

1. Injection apparatus for use with a syringe having a port end through which liquid is drawn into the syringe and a container of a liquid pharmaceutical having an outlet that supplies the liquid to the syringe, said apparatus comprising:

means mounted on the outlet of the container for encoding the container, said means having distinctive coding that distinguishes the container from other containers; and a sleeve sized to be selectably and securely mounted on the syringe by being slipped onto the port end of the syringe, so that said sleeve is proximate to said means when the liquid is withdrawn into the syringe through the outlet, said sleeve being permanently encoded such that coding on said sleeve matches coding on said means, whereby the source of the liquid in the syringe can be readily identified and whereby the coding on said encoding means and on said sleeve can be readily compared when the liquid is supplied to the syringe, so that errors producing a misidentification of the liquid in the syringe are eliminated;

thereby providing clear, reliable and economical means for identifying the liquid contained in such syringe.

2. Injection apparatus as claimed in claim 1, wherein said means for encoding the container comprises a penetrator that is inserted into the outlet of the container and is sized to be connected to the port end of the syringe, said penetrator having distinctive coding that distinguishes the container in which said penetrator is inserted from other containers.

3. Injection apparatus for use with a syringe and a penetrator adapted to be inserted in the outlet of a container of a liquid pharmaceutical, said apparatus comprising:

a cuff mounted securely on the distal end of the penetrator, said cuff being permanently encoded, said cuff having distinctive coding thereon that distinguishes the container in which the penetrator is inserted from other containers; and a sleeve sized to be selectably and securely mounted on the syringe by being slipped onto the port end of the syringe, so that said sleeve is proximate to said cuff when the liquid is drawn into the syringe through the penetrator, said sleeve being permanently encoded such that coding on said sleeve matches said distinctive coding on said cuff, whereby the source of the liquid in the syringe can be readily identified and whereby said cuff and said sleeve are brought into proximity when the liquid is drawn into the syringe through the penetrator, so that errors producing a misidentification of the liquid in the syringe are eliminated.

thereby providing clear, reliable and economical means for identifying the liquid contained in the syringe.

4. Injection apparatus as claimed in claim 2 wherein said penetrator is permanently encoded.

5. A method for identifying the liquid withdrawn from the outlet of a container into a syringe having a port end through which liquid is drawn into the syringe, to assure correct use of pharmaceuticals, said method comprising the steps of:

encoding the outlet of the container from which the liquid is to be withdrawn with distinctive coding that distinguishes the container from other containers;

selecting a syringe for injecting said liquid;

slipping a permanently encoded sleeve on the port end of said syringe, said sleeve being sized to be thus selectably and securely mounted thereon, said sleeve being encoded such that coding on said sleeve matches said distinctive coding on the container that distinguishes the container;

applying said port end of said syringe to said encoded container to draw said liquid into said syringe; and comparing said coding on the container with said coding on said sleeve while the liquid is being drawn into said syringe, whereby errors producing a misidentification of the liquid in the syringe are eliminated, thereby providing clear, reliable and economical means for identifying the liquid contained in said syringe.

6. The method claimed in claim 5 wherein said step of encoding the container comprises the steps of:

inserting a proximal portion of a penetrator into the container, the distal portion of said penetrator having said distinctive coding thereon.

7. The method claimed in claim 5 wherein the step of encoding the container comprises the steps of:

inserting the proximal portion of the penetrator into the container; and mounting a permanently encoded cuff on the distal portion of said penetrator, said cuff having said distinctive coding thereon.

8. Injection apparatus for use with a syringe having a port end through which liquid is drawn into the syringe and a container of a liquid, said container having distinctive coding mounted on the outlet thereof that supplies liquid to the syringe, said coding distinguishing the contents of the container, said apparatus comprising:

a sleeve sized to be selectably and securely mounted on said port end of the syringe by slipping said sleeve onto said port end; and coding permanently affixed to said sleeve and matching coding on the outlet of the container, whereby the container from which the liquid in the syringe was withdrawn can be readily identified and whereby the coding on the encoding means and on said sleeve can be readily compared when the liquid is supplied to the syringe, so that errors producing a misidentification of the liquid in the syringe are eliminated, thereby providing a clear, reliable and economical means for identifying the liquid contained in the syringe.

* * * * *